US006225989B1

(12) United States Patent
Wu et al.

(10) Patent No.: US 6,225,989 B1
(45) Date of Patent: May 1, 2001

(54) MATRIX CHARACTER GENERATION SYSTEM

(75) Inventors: Fu-Sheng Wu, Taoyuan; Yi-Hui Huang, Hsien, both of (TW)

(73) Assignee: Arphic Technology Co., Ltd., Taipei (TW)

( * ) Notice: Subject to any disclaimer, the term of this patent is extended or adjusted under 35 U.S.C. 154(b) by 0 days.

(21) Appl. No.: 09/163,323

(22) Filed: Sep. 30, 1998

(51) Int. Cl.[7] ..... G09G 5/24
(52) U.S. Cl. ..... 345/194; 345/192; 345/469
(58) Field of Search ..... 345/467, 471, 345/141, 142, 192, 194, 195

(56) References Cited

U.S. PATENT DOCUMENTS 4,990,903 * 2/1991 Cheng et al. ..... 345/143
5,852,448 * 12/1998 Cheng ..... 345/469
5,923,321 * 7/1999 Huang ..... 345/192

* cited by examiner

*Primary Examiner*—Kee M. Tung
(74) *Attorney, Agent, or Firm*—Winston Hsu

(57) ABSTRACT

The present invention provides a matrix character generation system comprising a memory for storing data and programs, a processor for executing the programs stored in the memory, and a screen for displaying matrix graphs generated by the matrix character generation system. The memory comprises a character table for recording all the strokes that form each character, a stroke table for recording the parameters of each stroke, and a graph generation program for displaying the matrix graph of each character on the screen according to the character table and the stroke table. When generating a new character, the graph generation program searches the character table for the stroke IDs of all the strokes of the character and the position of each stroke in the matrix according to the WID of the character. Then it searches the stroke table for the matrix graphic data of each stroke according to the stroke ID of each stroke. Finally, it draws the matrix graph of each stroke in the matrix according to the position and matrix graphic data of each stroke to form the matrix graph of the character.

5 Claims, 2 Drawing Sheets

18

| 30 | 32 34 |
|---|---|
| WID 0 | $SID_{21}(X_1,Y_1)$ $SID_4(X_2,Y_2)$ $SID_{15}$ ··· |
| WID 1 | $SID_{191}(X_1,Y_1)$ $SID_{23}(X_2,Y_2)$ $SID_{19}$ ··· |
| WID 2 | $SID_{119}(X_1,Y_1)$ $SID_8(X_2,Y_2)$ $SID_{40}$ ··· |
| WID 3 | $SID_5$ $(X_1,Y_1)$ $SID_{90}(X_2,Y_2)$ $SID_{52}$ ··· |
| WID 4 | $SID_0$ $(X_1,Y_1)$ $SID_{17}(X_2,Y_2)$ $SID_{81}$ ··· |
| ⋮ | ⋮ ⋮ |

*FIG. 3*

20

| 32 | 42 | 44 |
|---|---|---|
| SID 0 | $N_0$ | $(Y_1,XL_1,XR_1)(Y_2,XL_2,XR_2)$ ··· |
| SID 1 | $N_1$ | $(Y_1,XL_1,XR_1)(Y_2,XL_2,XR_2)$ ··· |
| SID 2 | $N_2$ | $(Y_1,XL_1,XR_1)(Y_2,XL_2,XR_2)$ ··· |
| SID 3 | $N_3$ | $(Y_1,XL_1,XR_1)(Y_2,XL_2,XR_2)$ ··· |
| SID 4 | $N_4$ | $(Y_1,XL_1,XR_1)(Y_2,XL_2,XR_2)$ ··· |
| ⋮ | ⋮ | ⋮ |

*FIG. 4*

MATRIX CHARACTER GENERATION SYSTEM

BACKGROUND OF THE INVENTION

1. Field of the Invention

The present invention relates to a matrix character generation system, and more particularly, to a matrix character generation system for generating a character by using a character table and a stroke table.

2. Description of the Prior Art

Printed Chinese characters can be generally divided into two categories: contour characters and matrix characters. A contour character is usually formed by using a stroke-combination character technique which treats each character as a structural graph combined by strokes, each stroke being a sub-graph of the character and consisting of a contour. Alternatively, a matrix character is treated as a matrix graph formed by points drawn in a matrix.

Please refer to FIG. 1. FIG. 1 shows the matrix graph 10 of a 16×16 scale matrix character. The matrix graph 10 comprises 256 small squares. Each square is black or white and corresponds to one bit of data. The digital number of "0" is represented by a white square and "1" is represented by a black square. The data of the matrix graph is stored in sequence from the upper left to the lower right of the matrix. All the black and white squares in the matrix graph 10 constitute a Chinese character, e.g. 「仁」, and are sequentially stored in this way:"00 00 00 00 06 00 00 0C 00 18 00 39 F0 68 00 08 00 0B FC 08 00 08 00 08 00 00 00 00 00 00 00". The total data amount of this 16×16 scale matrix graph is 32 bits. The bigger the matrix, the larger the data amount. A 24×24 scale character corresponds to 72 bits of data, a 32×32 scale character corresponds to 128 bits, and a 48×48 scale character corresponds to 288 bits. A Chinese font comprises about thirteen thousand characters and as such a 48×48 scale Chinese font corresponds to about 3.744 MB of data which can be reduced to about 1.5 MB when a good compression technique is applied. However, 1.5 MB of data is still too large for a small sized electrical commercial product, such as a beeper, a cellular phone, etc. Moreover, if the small sized electrical commercial product is equipped with more than one matrix font with different sizes, the required memory becomes prohibitively large leading to increased costs.

SUMMARY OF THE INVENTION

It is therefore a primary objective of the present invention to provide a matrix character generation system for generating a character by using a stroke table and a character table to reduce the data amount to solve the above mentioned problem.

In a preferred embodiment, the present invention provides a matrix character generation system for generating a matrix graph of a matrix character in a matrix according to the word ID of the character, the matrix character generation system comprising:

a memory for storing data and programs;

a processor for executing the programs stored in the memory;

a stroke table stored in the memory comprising a stroke ID and matrix graphic data for each of a plurality of strokes, the matrix graphic data of each stroke being used to draw the matrix graph of the stroke in the matrix;

a character table stored in the memory comprising a word ID for each of a plurality of characters, a stroke ID for each stroke of each of the characters, and position of each stroke of each character within the matrix; and a graph generation program stored in the memory for displaying the matrix graph of the word in the matrix according to the WID of the character, the character table, and the stroke table.

When generating a new character, the graph generation program searches the character table for the stroke IDs of all the strokes of the character and the position of each stroke in the matrix according to the word ID of the character. It then searches the stroke table for the matrix graphic data of each stroke according to the stroke IDs of each stroke of the character. Finally, it draws the matrix graph of each stroke in the matrix according to the position and matrix graphic data of each stroke thereby forming the matrix graph of the character.

It is an advantage of the present invention that the matrix character generation system only stores a small amount of data including the WID of each character, the position of each stroke, and the data constituting each stroke thus saving a lot of memory space.

These and other objectives of the present invention will no doubt become obvious to those of ordinary skill in the art after reading the following detailed description of the preferred embodiment which is illustrated in the various figures and drawings.

BRIEF DESCRIPTION OF THE DRAWINGS

FIG. 3 is a schematic diagram of the data structure of the character table shown in FIG. 2.

FIG. 4 is a schematic diagram of the data structure of the stroke table shown in FIG. 2.

DETAILED DESCRIPTION OF THE PREFERRED EMBODIMENT

Figure 1:
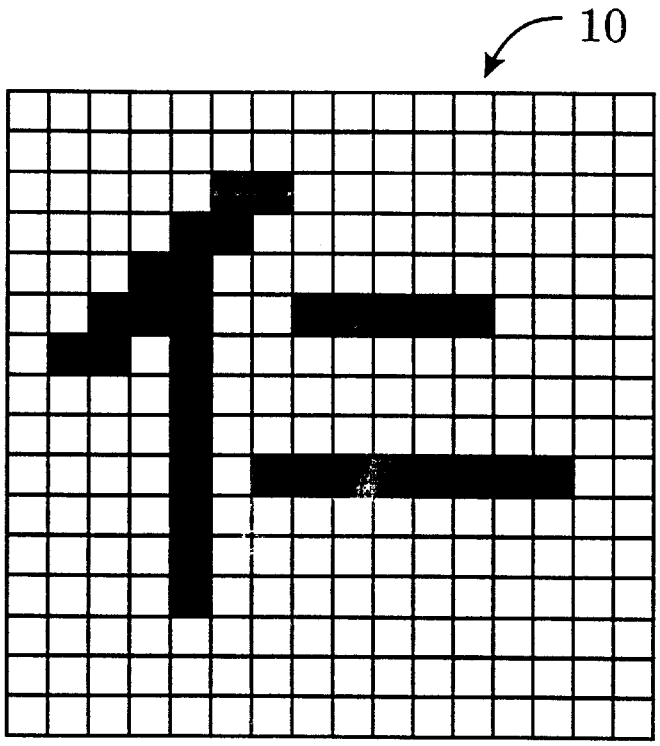
FIG. 1 shows a matrix graph of a 16×16 scale matrix character.
Figure 2:
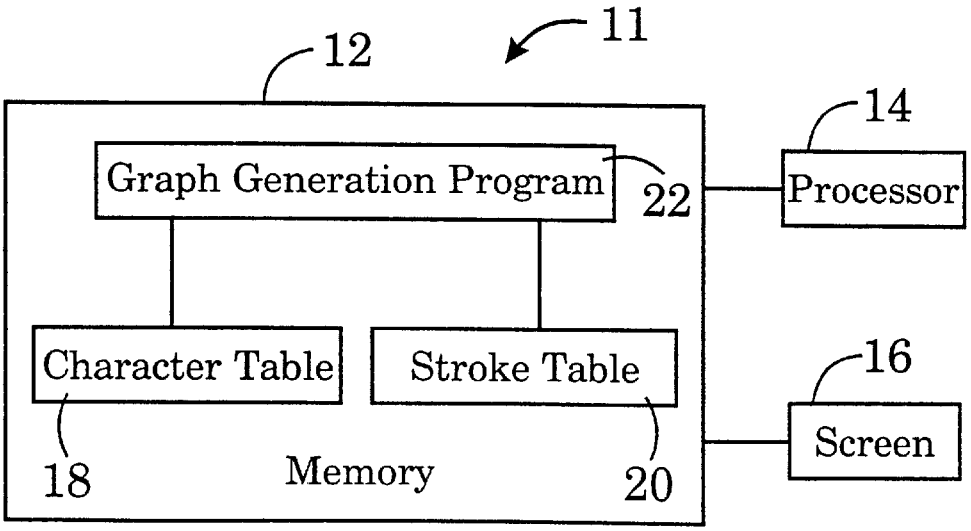
FIG. 2 is a functional block diagram of a matrix character generation system according to the present invention.

Please refer to FIG. 2. FIG. 2 is a functional block diagram of a matrix character generation system 11 according to the present invention. The matrix character generation system 11 comprises a memory 12 for storing data and programs, a processor 14 for executing the programs stored in the memory 12, and a screen 16 for displaying matrix graphs generated by the matrix character generation system 11. The memory 12 comprises a character table 18 for recording all the strokes forming each character, a stroke table 20 for recording the parameters of each stroke, and a graph generation program 22 for displaying the matrix graph of each character on the screen 16 based on information from the character table 18 and the stroke table 20.

Please refer to FIG. 3 and FIG. 4. FIG. 3 is aschematic diagram of the data structure of the character table 18 shown in FIG. 2. FIG. 4 is a schematic diagram of the data structure of the stroke table 20 shown in Fig.2. The character table 18 comprises the WID 30 of each character, the SIDs 32 of all the strokes constituting the character, and the parameters 34 indicating the position of each stroke in the matrix. The stroke table 20 comprises the SID 32 of each stroke, the number 42 of the horizontal lines forming the matrix graph of the strokes, and the parameter 44 corresponding to the start and ending points of each horizontal line. Each of the horizontal lines constituting each stroke is composed of a series of squares along a horizontal direction in the matrix.

For example, the stroke positioned on the upper right side of the Chinese character 「仁」 consists of five horizontal lines. Since these lines are straight, it is easy to draw them by using the parameters of their start and ending points. Once all the horizontal lines are drawn, the corresponding stroke is finished. Besides recording the parameters of all the horizontal lines of each stroke, the strokes can be constructed by recording horizontal lines at fixed or varying intervals, lines of another direction, or points rather than lines.

When generating a specific character, the graph generation program 22 searches the character table 18 for the SIDs of all the strokes of the character and the position parameters 34 of each stroke in the matrix according to the WID of the character. Then it searches the stroke table 20 for the number 42 of horizontal lines constituting each stroke and the parameters 44 of the start and ending points of each horizontal line according to the SID 32 of each stroke. Finally, it displays the matrix graph of the character on the screen 16 according to the position parameters 34 of each stroke, the number 42 of each horizontal line, and the parameters 44 of the start and ending points of each horizontal line.

In contrast to the prior art matrix character generation system which generates a character by recording the data of all the small squares in a matrix, the matrix character generation system 11 of the present invention only records the SIDs of each character, the position parameter 34 of each stroke, and the data of the lines constituting each stroke. Using the matrix character generation system 10, a font of about thirteen thousand characters requires only about 0.5 MB which is one third of that needed using the prior art.

Those skilled in the art will readily observe that numerous modifications and alterations of the device may be made while retaining the teachings of the invention. Accordingly, the above mentioned disclosure should be construed as limited only by metes and bounds of the appended claims.

What is claimed is:

1. A matrix character generation system for generating a dot matrix graph of a character in a dot, matrix format according to a word ID of the character, the matrix character generation system comprising:

a memory for storing data and programs;

a processor for executing the programs stored in the memory;

a stroke table stored in the memory comprising a stroke ID and dot matrix data pre-stored in the memory for each of a plurality of strokes, the dot matrix data of each stroke being used to display the matrix graph of the stroke in a dot matrix, wherein the dot matrix data of each stroke comprises the data of dots constituting the dot matrix graph of the stroke;

a character table stored in the memory comprising a word ID for each of a plurality of characters, a stroke ID for each stroke of each of the characters, and the position of each stroke of each character within the dot matrix; and a graph generation program stored in the memory for displaying the dot matrix graph of one character in the dot matrix according to the word ID of the character, the character table and the stroke table;

wherein the graph generation program searches the character table for the stroke IDs of all the strokes of the character and the position of each stroke in the dot matrix according to the word ID of the character, searches the stroke table for the dot matrix data of each stroke according to the stroke ID of each stroke of the character, and displays the dot matrix graph of the character in the dot matrix format according to the position and the dot matrix data of each stroke.

2. The matrix character generating system of claim 1 wherein the dot matrix data of each stroke comprises the data of all the horizontal lines constituting the dot matrix graph of the stroke, and the graph generation program draws the stroke in the dot matrix format to form the dot matrix graph of the stroke according to the position of the stroke and the data of all the horizontal lines in the dot matrix data of the stroke.

3. The matrix character generating system of claim 2 wherein the dot matrix data of each stroke comprises parameters corresponding to the start and ending dots of each horizontal line constituting the matrix graph of the stroke.

4. The matrix character generating system of claim 1 wherein the dot matrix data of each stroke comprises the data of all the vertical lines constituting the dot matrix graph of the stroke, and the graph generation program draws the stroke in the dot matrix format to form the dot matrix graph of the stroke according to the position of the stroke and the data of all the vertical lines in the dot matrix data of the stroke.

5. The matrix character generating system of claim 4 wherein the dot matrix data of each stroke comprises parameters corresponding to the start And ending dots of each vertical line constituting the dot matrix graph of the stroke.

* * * * *